US005885763A

United States Patent [19]

Verrept et al.

[11] Patent Number: 5,885,763

[45] Date of Patent: Mar. 23, 1999

[54] METHOD FOR THE PREPARATION OF AN IMPROVED PHOTOGRAPHIC TABULAR EMULSION RICH IN CHLORIDE

[75] Inventors: Peter Verrept, Avelgem; Hieronymus Andriessen, Beerse, both of Belgium

[73] Assignee: AGFA-Gevaert, N.V., Mortsel, Belgium

[21] Appl. No.: 956,362

[22] Filed: Oct. 23, 1997

[51] Int. Cl.[6] ..... G03C 1/035; G03C 1/005; G03C 1/047

[52] U.S. Cl. ..... 430/569; 430/567; 430/642; 430/966

[58] Field of Search ..... 430/567, 569, 430/642, 966

[56] References Cited

U.S. PATENT DOCUMENTS

| | | | |
|---|---|---|---|
| 5,356,764 | 10/1994 | Szajewski et al. | 430/505 |
| 5,413,904 | 5/1995 | Chang et al. | 430/569 |
| 5,587,281 | 12/1996 | Saitou et al. | 430/567 |
| 5,663,041 | 9/1997 | Chang et al. | 430/569 |

FOREIGN PATENT DOCUMENTS

| | | | |
|---|---|---|---|
| 645670 | 3/1995 | European Pat. Off. | G03C 1/035 |
| 709727 | 5/1996 | European Pat. Off. | G03C 1/30 |
| 809135 | 11/1997 | European Pat. Off. | G03C 1/005 |

*Primary Examiner*—Mark F. Huff
*Attorney, Agent, or Firm*—Breiner & Breiner

[57] ABSTRACT

A method is disclosed of preparing of a photographic silver halide emulsion comprising precipitating in one or more precipitation steps in a reaction vessel, followed by desalting by means of flocculation and washing or by means of ultrafiltration, said emulsion comprising gelatin as a binder and {100} tabular silver halide grains containing at least 50 mole % of chloride, wherein at least 40% by number of all grains is provided by said tabular grains, and wherein said tabular grains exhibit an average aspect ratio of at least 2, an average thickness of at most 0.5 $\mu$m, and an average equivalent circular crystal diameter of 0.3 $\mu$m or more, characterized in that during said precipitation step(s) said gelatin binder present in said reaction vessel is substantially free of calcium ions and is oxidized to a degree in order to have a methionine content of at most 4000 ppm.

10 Claims, 3 Drawing Sheets

Figure 1:
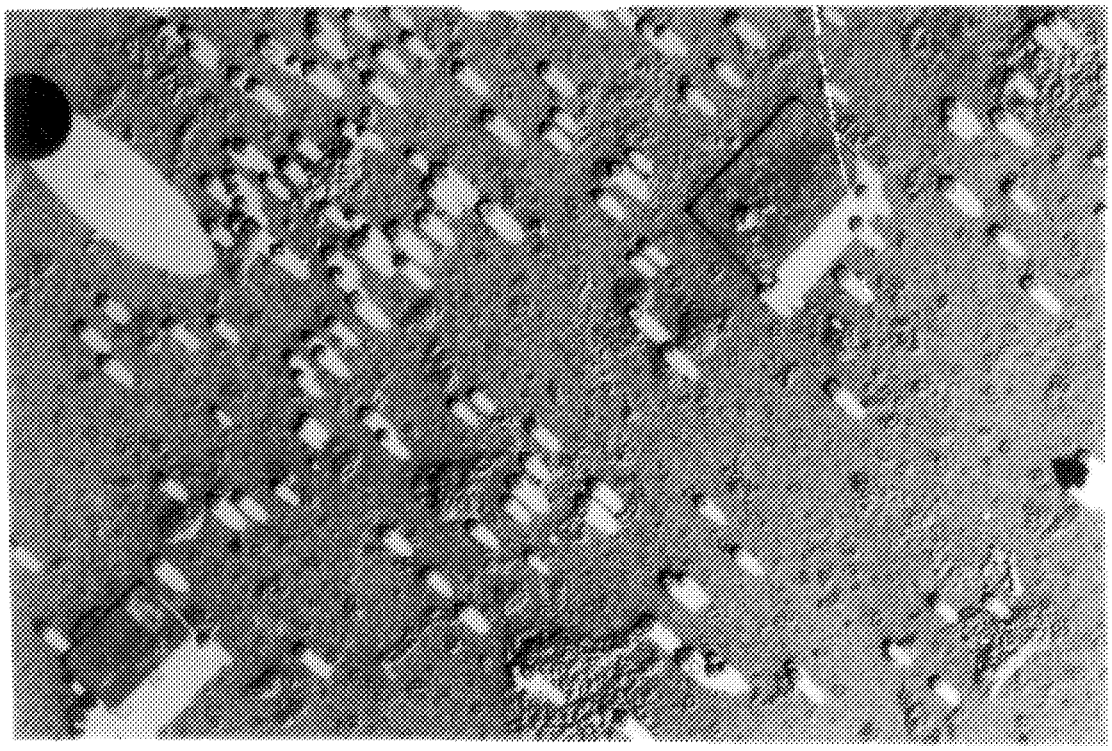

METHOD FOR THE PREPARATION OF AN IMPROVED PHOTOGRAPHIC TABULAR EMULSION RICH IN CHLORIDE

DESCRIPTION

1. Field of the Invention

The present invention deals with the preparation method of a light-sensitive silver halide emulsion rich in chloride tabular grains having a {100} crystal habit.

2. Background of the Invention

High aspect ratio tabular grains exhibit several pronounced photographic advantages. Thanks to their particular morphology greater amounts of spectral sensitizers can be adsorbed per mole of silver halide if compared with classical globular grains. As a consequence such spectrally sensitized tabular grains show an improved speed-granularity relationship and a wide separation between their blue speed and minus blue speed. Sharpness of photographic images can be improved using tabular grains thanks to their lower light scattering properties, again if compared with conventional globular emulsion grains. In color negative materials e.g. the conventional sequence of the light-sensitive layers can be altered and the yellow filter layer can be omitted. In developed black-and-white images high covering power is obtained even at high hardening levels. Alternatively reduced silver halide coverages can be achieved if desired, which again results in improved sharpness. In duplitized radiographic materials the presence of tabular grains reduces the so-called cross-over which is the main factor for sharpness in such materials. Moreover coating amounts of silver can be reduced, further in favor of production cost and ecology.

An emulsion is generally understood to be a "tabular grain emulsion" when tabular grains account for at least 50 percent of total grain projected area. A grain is generally considered to be a tabular grain when the ratio of its equivalent circular diameter to its thickness is at least 2. The equivalent circular diameter of a grain is the diameter of a circle having an area equal to the projected area of the grain.

Early patent disclosures on high aspect tabular grains, e.g. U.S. Pat. Nos. 4,434,226; 4,439,520; 4,425,425; 4,425,426; 4,433,048 and Research Disclosure, Vol. 225, January 1983, Item 22534, are concerned with high sensitive silver bromide or silver iodobromide emulsions.

In a lot of photographic applications high sensitivity is less important. In these cases the use of emulsions rich in chloride is advantageous thanks to their higher development and fixing rates favourable in rapid processing applications. Typical examples include graphic arts contact materials, duplicating materials, hard-copy materials, diffusion transfer reversal materials and black-and-white or color print materials. However when combined, high sensitivity and rapid processing applicability are highly appreciated. So it remains interesting to combine the advantages of emulsions rich in chloride with the advantages of a tabular grain structure.

Silver halide tabular grains rich in chloride can i.e. have parallel faces in the {111} crystal plane or in the {100} crystal plane, thus providing a tabular {111} or a tabular {100} habit respectively.

In earlier disclosures most attention was paid to the preparation of tabular grains rich in chloride having a {111} crystal habit as in U.S. Pat. Nos. 4,400,463; 4,713,323; 4,804,621; 5,183,732; 5,185,239; 5,178,998; 5,178,997 and in EP-A 0 481 133.

The first publications on tabular grains bounded by {100} parallel major faces were related with silver iodobromide emulsions. Bogg in U.S. Pat. No. 4,063,951 and Mignot in U.S. Pat. No. 4,386,156 were the most important publications.

In EP-A 0 534 395 Brust et al. disclose the first {100} tabular emulsion grains rich in chloride and a process for preparing them wherein the tabular grain fraction showing {100} major faces is significant. Further improvements and variations on the teachings of the said tabular {100} emulsions rich in chloride have been described in U.S. Pat. Nos. 5,024,931; 5,264,337; 5,275,930; 5,292,632; 5,310,635; 5,314,798; 5,320,938; 5,356,764; in WO-Applications 94/22051 and 94/22054 and in EP-A's 0 569 971; 0 584 815; 0 584 644; 0 602 878; 0 616 255; 0 617 317; 0 617 320; 0 617 321; 0 617 325; 0 618 492 0 618 493; 0 653 659 and 0 653 669.

In conventional photographic materials for radiographic recording high-sensitive silver (iodo)bromide tabular emulsions are currently used. However with respect to recent trends to rapid processing applications it is desirable to use silver halide emulsions rich in chloride as the said emulsions show a faster developability as has e.g. been disclosed in EP-A 0 678 772.

One of the major problems arising in the preparation methods of {111} tabular grains rich in chloride is the problem of crystallographic stability, which after making use of a crystal habit modifier in the preparation step of the said grains requires the cumbersome step of replacing the said habit modifier by other compounds adsorbed at the large crystal surface as has e.g. been demonstrated in U.S. Pat. No. 5,221,602. Due to the steps of adsorbing, desorbing and replacing different adsorbing compounds the reproducibility and stability of the grains is questionable.

As shown e.g. in EP-A 0 653 669 during the preparation of {100} tabular grains rich in chloride the presence of such an absorbing crystal habit modifier is not required as an excellent crystallographic stability is obtained. Moreover improved sensitometric characteristics, especially with respect to sensitivity, if compared with equivalent non-tabular cubic emulsion crystals are therein obtained.

As it has always been important to get a percentage of tabular grains as high as possible within the whole emulsion crystal population, in favor of all properties offered by the said tabular grains, it is clear that every improvement in that direction is highly appreciated. An attempt to reach that object, particularly for high chloride {100} tabular grains comprising iodide ions, has been described in U.S. Pat No. 5,413,904 wherein it has been proposed as an indispensable asset to delay the introduction of iodide ions in the reaction vessel until after grain nucleation has occurred. The present invention further extends the teachings on tabular emulsions grains rich in chloride having a {100} crystal habit.

3. Objects and Summary of the Invention

It is an object of the present invention to provide a method of preparing photographic light-sensitive tabular emulsion grains rich in chloride having a {100} crystal habit wherein the percentage by number of the said tabular grains is enhanced.

Other objects of the invention will become clear from the description hereinafter.

The objects of the present invention are realized by providing a method of preparing of a photographic silver halide emulsion comprising precipitating in one or more precipitation steps in a reaction vessel, followed by desalting by means of flocculation and washing or by means of ultrafiltration, said emulsion comprising gelatin as a binder and {100} tabular silver halide grains containing at least 50 mole % of chloride, wherein at least 40% by number of all grains is provided by said tabular grains, and wherein said tabular grains exhibit an average aspect ratio of at least 2, an average thickness of at most 0.5 μm, and an average equivalent circular crystal diameter of 0.3 μm or more, characterized in that during said precipitation step(s) said gelatin binder present in said reaction vessel is substantially free of calcium ions and is oxidized to a degree in order to have a methionine content of at most 4000 ppm.

4. Detailed Description of the Invention

The calcium content of most commercial high-quality inert gelatins is about 0.4% or about 100 mmol/kg, measured at the end of the preparation process of inert gelatin. The basis for a high-quality gelatin is preferably formed by pure, degreased hard cattle bones. In a first preparation step the bones are treated with acid in order to remove calcium and magnesium phosphates. This step is followed by an alkaline hydrolysis step, wherein mostly use is made of calcium hydroxide. At the low pH used to remove the phosphates the calcium ions, bound to specific amino acids of the polypeptide, are exchanged with the protons from the used acid. During the alkaline hydrolysis with calcium hydroxide the polypeptide is saturated with calcium ions again. After diafiltration the non-removable calcium concentration in the gelatin is about 0.5% or 125 mmol/kg. When slightly acidifying during washing the calcium content can be reduced to about 0.4% (40 ppm) or 100 mmol/kg. These and other data can be found in the scientific publication "Influence of Calcium on the Physical properties of Gelatin Solutions and on Symplex Formation with Macromolecular Polyanions" by B. H. Tavernier, *J. Phot. Sci.,* Vol. 40, (1992), p. 168–173. The author reached the conclusion that complex-bound calcium ions strongly decrease the electric potential carried by gelatin. The influence of calcium ions on physical characteristics such as viscosity was found to be non-significant.

So called "calcium free gelatin" is obtained by cation exchange by means of an ion exchange resin, preferably a so-called mixed-bed resin. Substantially "calcium free gelatin" is thus defined as gelatin with a calcium content at a level below 40 ppm which corresponds with the analytical detection limit.

Patent references on gelatins free from calcium or poor in calcium are rather scarce. In JP-A 05-173278 a color negative material is described hardened with a vinyl sulphonyl hardener type and containing a calcium poor gelatin. In JP-A 04-321026 a black-and-white multicontrast material is disclosed using a specific calcium poor gelatin. In JP-A 02-300745 a specific AgX material is described comprising gelatin with a calcium content of less than 100 ppm. In that reference especially sensitometric improvements have been described. Further influences on chemical ripening properties, especially with respect to fog, have been described in JP-A 62-006251. Improvements with respect to coating properties can be read in U.S. Pat. No. 5,188,931 and 5,496,691 and in JP-A 03-174142. Influences on viscosity making further use of small amounts of viscosity increasing agents have been described in JP-B 92-062064.

Prevention of roller marks thanks to the use of gelatin containing less calcium has been described in JP-A 01-179141, whereas adhesion properties and curl of materials comprising a defined calcium ion content have been described in U.S. Pat. No. 5,496,691. Influences on surface glare have been described in JP-B 91-080292. Drying properties of materials run in rapid processing applications of a material having a well-defined amount of calcium in its gelatinous binder have been described in JP-A's 01-073337, 03-253839 and 07-140576; and in U.S. Pat. Nos. 5,318,881 and 5,302,505.

In EP-Application No. 96201371, filed May 21, 1996 now European Patent 809,135 a process has been disclosed for the preparation of a photographic silver halide emulsion comprising one or more precipitation steps in a reaction vessel, said emulsion comprising tabular {111} grains, containing at least 50 mole % of chloride, wherein at least 50% of the total projected area of all grains is provided by said tabular grains, and wherein said tabular grains exhibit an average aspect ratio of at least 5, an average thickness of at most 0.5 μm, and an average diameter of at least 0.6 μm, characterized in that during said one or more precipitation steps a gelatin binder is present in said reaction vessel which is substantially free of calcium ions.

On the other hand oxidized gelatin is, according to Maskasky in U.S. Pat. No. 4,713,323, defined as a gelatin having a methionine content of less than 30 μmol/g, which corresponds with an amount of about 4400 ppm or less. Gelatin can be oxidized by means of e.g. hydrogen peroxide. A publication on the determination of methionine and its oxides in gelatin can be found e.g. in *J. Phot. Sci.,* Vol. 41, (1993), p. 172–175, by S. Tani and T. Tani.

A high number of tabular grains rich in bromide in the total grain population is obtained if use is made in the preparation method of so-called "oxidized gelatin", characterized by the presence in the said gelatin of amounts of methionine of less than 30 μmoles per gram of gelatin as claimed in U.S. Pat. No. 4,713,320. Opposite thereto the same author discloses a preparation process of high chloride tabular grain emulsions wherein use is made of a high methionine gelatino-peptizer, in the presence of specified pyrimidine grain growth modifiers. A high number of tabular {100} grains has been reached in a preferred silver chloroiodide emulsion prepared by the method described in U.S. Pat. No. 5,413,904, wherein from the Examples the presence in the reaction vessel of oxidized gelatin seems to be an essential feature, although it has not specifically been claimed therein, whereas nothing therein refers to the presence of gelatin substantially free from calcium ions as a second, preferably simultaneously present, essential feature as in the present invention.

A preparation method of tabular grain emulsions wherein in the grain growth process use is made of gelatin derivatives with chemically modified $NH_2$-groups and wherein said gelatin has a specific methionine content has been described in EP-A 0 697 618. Modification of the methionine content of a gelatino-dispersion medium by means of an oxidizer which should be added to the reaction vessel immediately before nucleation formation has been described in U.S. Pat. No. 5,372,975, wherein seed grains are further added. Seed grains formed in the presence of an oxidizing agent have been described in JP-A 05-210187, in JP-A 06-003758 and in JP-A 06-003759. Processing a gelatin solution by means of $H_2O_2$ has e.g. been described in JP-A 05-341415. Other oxidizing agents besides hydrogen peroxide as e.g. ozone, peroxy acid salts, halogens, thiosulphonic acid salts, quinones and organic peroxides have been used in U.S. Pat. No. 5,489,504. Further in order to provide tabular grains having small twin-plane separations in tabular grains rich in silver bromide a preparation method making use of oxidized gelatin has been described in U.S. Pat. No. 5,219,720. Oxidation of methionine reduces the complexing ablity of gelatin. Modification of complexing ability can be performed in different steps during precipitation, as e.g. in the precipitation of silver halide tabular grains as has described in JP-A 07-311428, wherein hydrogen peroxide is added after nucleation, during the following physical ripening step.

A preparation method of gelatin having a controlled methionine content is disclosed in U.S. Pat. No. 5,412,075. In order to determine the methionine content of gelatin in a quantitative manner many references from literature are available as e.g. in J.Phot.Sc., Vol. 28(1980), p.111–118 wherein as most obvious reducing substances in gelatin methionine residues of the macromolecule are determined in reaction with Au(III)-ions. The so-called "gold number" permits determination of amounts of methionine in the gelatin following the rule that 1 $\mu$mole of Au corresponds with 1.6 $\mu$mole of methionine. In J.Phot.Sc., Vol. 33(1989), p.10–17 the methionine content was determined using the gaschromatographic procedure developed by Apostolatos and Hoff (Anal. Biochem. Vol. 118(1981), p.126) and applied to gelatin by Rose and Kaplan. In this article calorimetry is used in a quantitative procedure for determining methionine (constant over initial pH range examined: 3.0–8.0). In J.Phot.Sc., Vol. 40(1992), p.149–151 amounts of methionine, methionine sulphoxide and methionine sulphone are determined by a chromatographic technique for amino acids (Hitachi Amino Acid Analyser), whereas in J.Phot.Sc., Vol. 41(1993), p.172–175 these compounds are determined by HPLC-techniques. In J.Phot.Sc., Vol. 39(1995), p. 367–372 it has been established that a good correlation between methionine content determined by Rose and Kaplan making use of gas chromatographic techniques (4th IAG Conference, Fribourg 1985, Amman-Brass & Pouradier) and the Scatchard technique (described in J.Phot.Sc., Vol. 42(1994), p.117–119) can be found. In the said technique the interaction at pH=3.0 of $Ag^+$ and gelatin is determined by means of potential measurements of free $Ag^+$-ions.

It was very surprising to find that the mere use of gelatin free from $Ca^{++}$-ions further having a methionin content of less than 4000 ppm as a binder during the preparation of tabular {100} grains rich in chloride was resulting in such a pronounced effect on the crystallographic properties obtained with respect to the formation of a higher percentage of tabular {100} grains by number, as well as by total projective surface. Moreover advantageous effects on sensitometric properties should not be denied: more tabular grains are formed that are smaller on the average but nevertheless show an excellent sensitivity.

Although emulsion precipitation can be principally performed by one double jet step it is preferred to perform a sequence of a nucleation step, at least one physical ripening step, and at least one growth step. Of the total silver halide preferably 0.5% to 5.0% is precipitated during said nucleation step which preferably consists of an approximately equimolecular addition of silver and halide salts. The rest of the silver and halide salts is added during one or more consecutive double jet growth steps. The different steps of the precipitation can be alternated by physical ripening steps. During the growth step(s) an increasing flow rate of silver and halide solutions is preferably performed as e.g. a linearly increasing flow rate. Typically the flow rate at the end is about 3 to 5 times greater than at the start of the growth step. These flow rates can be monitored by e.g. magnetic valves. During the growth step(s) the pAg is preferably maintained at a constant value corresponding to a silver potential preferably about 100 mV measured by a silver versus an Ag/AgCl Ingold electrode. The pH is preferably established at a value of between 2.0 and 10.0 and more preferably between 3.0 and 9.0.

Before and during the formation of the silver halide grains it is common practice to establish a gelatin concentration of from about 0.05% up to 100% by weight in the dispersion medium. According to the present invention this gelatin is "calcium free and oxidized", which means, according to the remarks made above, that an amount of less than 40 ppm of calcium ions and less than 4000 ppm of methionine is present. Additional gelatin may be added in a later stage of the emulsion preparation e.g. after washing, to establish optimal coating conditions and/or to establish the required thickness of the coated emulsion layer. This gelatin can be conventional calcium containing non-oxidized gelatin, having high amounts of methionine, but calcium free and/or oxidized gelatin is not excluded.

Preferably a ratio by weight of gelatin to silver halide ranging from 0.2 to 1.0 is then obtained, wherein silver halide is expressed as an equivalent amount of silver nitrate.

Tabular grains rich in chloride having a {100} crystal habit as in the present invention do not require the use of a crystal habit modifier during the emulsion preparation as is the case during preparation of {111} tabular grains, which is in favor of reproducibility.

After completion of the precipitation a wash technique in order to remove the excess of soluble salts is applied. Any conventional wash technique can be used e.g. washing with several water portions after flocculation by an inorganic salt or by a polymeric flocculating agent like polystyrene sulphonic acid. Emulsion washing has e.g. described in Research Disclosure N° 36544 (1994), Chapter III. In a preferred embodiment ultrafiltration is used as a wash technique. Such procedure has been disclosed e.g. in Research Disclosure Vol. 102, October 1972, Item 10208; in Research Disclosure Vol. 131, March, Item 13122 and in Mignot U.S. Pat. No. 4,334,012.

According to the preparation method of the present invention an emulsion comprising gelatin as a binder and {100} tabular silver halide grains containing at least 50 mole % of chloride, more preferably at least 70 mole % of chloride and still more preferably more than 90 mole % of chloride, wherein at least 40% by number and more preferably at least 60% by number of all grains is provided by said tabular grains, and wherein said tabular grains exhibit an average aspect ratio of at least 2, and more preferably between 3 and 50, an average thickness of at most 0.5 $\mu$m, and more preferably from 0.04 $\mu$m to 0.30 $\mu$m, and an average equivalent circular crystal diameter of 0.3 $\mu$m or more is thus obtained, the proviso that during said precipitation step(s) said gelatin binder present in said reaction vessel is substantially free of calcium ions and is oxidized to a degree in order to have a methionine content of at most 4000 ppm. In a more preferred embodiment said methionine content is at most 2500 ppm and even more preferred is a methionine content of less than 1500 ppm.

In a preferred embodiment the emulsion prepared according to the method of this invention is an emulsion comprising {100} tabular silver chloroiodide grains.

It is specifically contemplated that up to at most 3 mole percent of iodide ions are incorporated in the said silver chloroiodide grains. This can be achieved by mixing a soluble chloride and a soluble iodide salt, like potassium iodide, in one or more of the halide solutions up to the desired mole % concentrations required in each preparation step or by a triple jet technique, or separate addition of an iodide containing aqueous solution. Due to the about $10^6$ times lower solubility of silver iodide ions in comparison with silver chloride, said iodide ions are able to displace chloride ions from the grain, a technique known in the art as conversion. Iodide ions may also be incorporated into the silver halide crystal lattice by the addition of a previously prepared silver iodide micrate emulsion, composed of either pure silver iodide or mixed halides, but in a preferred embodiment iodide is provided by means of an iodide releasing agent. Patent applications referring to methods wherein iodide releasing agents are used are e.g. EP-A's 0 563 701, 0 563 708, 0 561 415 and 0 651 284. Even bromide releasing agents are not excluded in the precipitation steps according to the method of the present invention if bromide ions are incorporated in the {100} tabular grains rich in chloride prepared according to the method of the present invention.

Two or more types of tabular silver halide emulsions that have been prepared differently can be mixed for forming a photographic emulsion for use in accordance with the present invention.

The size distribution of the {100} tabular silver halide grains rich in chloride prepared according to the method of this invention can be monodisperse or heterodisperse.

Tabular silver halide emulsions comprising tabular {100} grains rich in silver chloride prepared by the method of the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, its selenium or its tellurium analogues, sulphites, mercapto compounds, and rhodamines. The emulsions can be sensitized also by means of gold-sulphur ripeners, or gold-selenium ripeners, or gold-sulphur-selenium ripeners, wherein in addition of or instead of selenium ripeners tellurium compounds may be added, or by means of reductors e.g. tin compounds as described in GB 789,823, amines, hydrazine derivatives, formamidine-sulphinic acids, and silane compounds.

The silver halide emulsions under consideration can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in Research Disclosure Item 22534. Oxacarbocyanines have been described e.g. in U.S. Pat. No. 5,434,042. Especially preferred green sensitizers in connection with the present invention are anhydro-5,5'-dichloro-3,3'-bis(n.sulfobutyl)-9-ethyloxacarbo-cyanine hydroxide and anhydro-5,5'-dichloro-3,3'-bis(n.sulfopropyl)-9-ethyl-oxacarbocyanine hydroxide. Imidacarbocyanines as e.g. those described in Research Disclosure N° 37312 (1995) may be useful as well as combinations of oxacarbocyanines and imidacarbocyanines as in EP-A 0 590 593 from the viewpoint of sensitivity as well as from the viewpoint of decoloring properties and stain removal in the processing of materials containing spectrally sensitized tabular grains. A suitable mixture of oxacarbocyanine and imidacarbocyanine spectral sensitizers that is applied in favor of decoloring properties and sensitometry is e.g. anhydro-5,5'-dichloro-3,3'-bis(n-sulphobutyl)-9-ethyl oxacarbocyanine hydroxide or anhydro-5,5'-dichloro-3,3'-bis(n-sulphopropyl)-9-ethyloxacarbo-cyanine hydroxide together with anhydro-5,5'-dicyano-1, 1'-diethyl-3,3 '-di(2-acetoxyethyl)ethyl-imidacarbocyanine bromide.

In classical emulsion preparation spectral sensitization traditionally follows the completion of chemical sensitization. However, in connection with tabular grains, it is specifically considered that spectral sensitization can occur simultaneously with or even precede completely the chemical sensitization step. In the preferred embodiment wherein the tabular {100}emulsion is a chloroiodide emulsion the spectral sensitizers are preferably added even before digestion of an ultrafiltrated emulsion or redispersion of a flocculated and washed emulsion: chemical sensitization after spectral sensitization is believed to occur at one or more ordered discrete sites of tabular grains. In praxis chemical sensitization may e.g. proceed in the presence of one or more phenidone and derivatives, a dihydroxy benzene as hydroquinone, resorcinol, catechol and/or a derivative(s) therefrom, one or more stabilizer(s) or antifoggant(s), one or more spectral sensitizer(s) or combinations of said ingredients. Especially 1-p-carboxyphenyl, 4,4'dimethyl-pyrazolidine-3-one may be added as a preferred auxiliary agent.

The gelatinous emulsion rich in silver chloride of the present invention, characterized by a specific gelatin composition as set forth hereinbefore is further coated in hydrophilic layer(s) which may, just as non-light-sensitive layers of the photographic material according to this invention, comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion layer or to other coating layers in water-permeable relationship therewith such as an undercoat or a protective layer. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-A 75-39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds have been described in Research Disclosure N° 17643 (1978), Chapter VI and in RD N° 36544 (1994), Chapter VII. Many of these fog-inhibiting compounds may have been already added during the chemical ripening of the tabular silver halide crystals rich in silver chloride.

It is clear that additional gelatin may be added in a later stage of the emulsion preparation, e.g. after washing, in order to establish optimal coating conditions and/or to establish the required thickness of the coated emulsion layer. Preferably a gelatin to silver halide ratio ranging from 0.2 to 1.0 is then obtained, wherein extra gelatin added is not required to have a composition as specific as in the preparation step of the grains according to the method of the present invention. Another binder may also be added instead of or in addition to gelatin. Useful vehicles, vehicle extenders, vehicle-like addenda and vehicle related addenda have been described e.g. in Research Disclosure N° 36544 (1994), Chapter II.

The gelatin binder of the photographic material having at least one gelatinous emulsion according to the present invention can be forehardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The gelatinous emulsions comprising tabular grains rich in silver chloride of the present invention can be used in various types of photographic elements e.g. black and white silver halide photographic materials, like materials used for X-ray diagnostic purposes, or colour sensitive materials.

In a preferred embodiment the photographic material is a photographic material comprising a support and at least one light-sensitive silver halide emulsion layer on at least one side of said support, wherein said emulsion layer(s) comprise(s) one or more emulsion(s) containing {100} tabular silver halide emulsion grains prepared according to the method of the present invention. In a further preferred embodiment said photographic material is a single or double side coated X-ray material.

The single-side coated X-ray material may contain one single emulsion layer, as it is the case for many applications, or it can be built up by two or even more emulsion layers. In X-ray photography a material with a single or a duplitized emulsion layer coated on one or both sides of the support thus contains at least one gelatinous silver halide emulsion according to the invention. By using duplitized emulsions differing in photographic speed by at least 0.15 log E a gain in cross-over exposure in double side coated materials can be obtained. In the case of color photography the material contains blue, green and red sensitive layers each of which can be single coated as in most common color positive materials, but merely consist of double or even triple layers as in color negative or color intermediate applications.

Besides the light sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes, etc.

The photographic element of the present invention may further comprise various kinds of coating physical property modifying addenda as described in RD N° 36544 (1994), Chapter IX, wherein coating aids, plasticizers and lubricants, antistats and matting agents have been described. Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element of the present invention may further comprise various other additives such as e.g. compounds improving the dimensional stability of the photographic element, UV-absorbers and spacing agents.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth) acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in RD N° 36544 (1994), Chapter VI, wherein also suitable optical brighteners are mentioned. UV-absorbers are especially useful in color materials where they prevent the fading by light of the color images formed after processing.

Spacing agents can be present of which, in general, the average particle size is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made of polymethyl methacrylate, copolymers of acrylic acid and methyl methacrylate and of hydroxypropylmethyl cellulose hexahydrophthalate. Other suitable spacing agents have been described in U.S. Pat. No. 4,614,708.

The photographic material may contain several non-light sensitive layers, e.g. an antistress topcoat layer, one or more backing layers, and one or more intermediate layers eventually containing filter- or antihalation dyes that absorb scattering light and thus promote the image sharpness. Suitable light-absorbing dyes used in these intermediate layers are described in e.g. U.S. Pat. Nos. 4,092,168, U.S. Pat. No. 4,311,787, DE-OS 2,453,217, and GB-A 7,907,440. Situated in such an intermediate layer between the emulsion layers and the support there will be only a small negligable loss in sensitivity but in rapid processing conditions decoloration of the filter dye layers may form a problem. Therefor it should be recommended to decrease the thickness of the whole coated layer packet resulting in shorter drying times after washing in the processing cycle. Alternatively the use of intermediate layers situated between emulsion layer(s) and support, reflecting the fluorescent light emitted by the screens may bring a solution. As the light emitted from the screens by the phosphors incorporated therein is a very important source of light-scattering the addition of appropriate filter dyes to the screens may be recommended. In the presence in the screens of e.g. green light-emitting phosphors use may be made of specific dyes as MAKROLEX ORANGE G or GG, trademarked products of BAYER AG.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an Alpha-olefin polymer, e.g. a polyethylene layer which optionally contains an anti-halation dye or pigment. It is also possible to use an organic resin support e.g. cellulose nitrate film, cellulose acetate film, poly(vinyl acetal) film, polystyrene film, poly(ethylene terephthalate) or poly(ethylene naphthalate) film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied. For example, in a preferred embodiment of materials for X-ray diagnostic purposes said materials may be adapted to rapid processing conditions in a developer containing hydroquinone as main developing agent or even free from hydroquinone: as a more ecological developing agent ascorbic acid, reductic acid or derivatives thereof may in part or integrally replace hydroquinone. Preferably an automatically operating processing apparatus is used provided with a system for automatic regeneration of the processing solutions.

The forehardened material may be processed using one-part package chemistry or three-part package chemistry, depending on the processing application determining the degree of hardening required in said processing cycle. Applications within total processing times of 30 seconds and lower up to 90 seconds, known as common praxis, are possible. From an ecological point of view it is e.g. possible to use sodium thiosulphate instead of ammonium thiosulphate.

The following examples illustrate the invention without however limiting it thereto.

EXAMPLE

This Example illustrates the influence on the crystal structure obtained at the end of silver halide precipitation of the presence of calcium ions in gelatin during the said precipitation.

Preparation of control Emulsion A (tabular silver chloroiodide emulsion, comparative emulsion, low degree of gelatin oxidation, high amount of calcium)

1160 ml of a dispersion medium (C) containing 156 g of gelatin containing 7000 ppm of methionine and 5000 ppm of calcium was provided in a stirred reaction vessel. The pCl was adjusted with sodium chloride to a value of 2.0; pH was adjusted to a value of 5.7 and the reaction vessel was held at a constant temperature of 350° C. While vigourously stirring this solution, 38 ml of a 2.94 molar solution of silver nitrate and 38 ml of a 2.94 molar solution of sodium chloride were added simultaneously at a rate of 24 ml per minute by double jet precipitation.

Into the said reaction vessel 1250 ml of a solution containing 456 mg of potassium iodide and 600 mg of sodium chloride was poured and the temperature of the mixture was raised to 50° C. during the next 5 minutes.

96 ml of a 2.94 molar solution of a silver nitrate solution and 38 ml of a 2.94 molar solution of a sodium chloride were added simultaneously at a rate of 8 ml per minute each, while maintaining the pCl value at 2.2 and the temperature at 50° C.

119 ml of a 2.94 molar solution of a silver nitrate solution and 119 ml of a 2.94 molar solution of a sodium chloride were further added simultaneously at a linearly increasing addition rate for both starting from 8 ml up to 12 ml per minute while the pCl value decreased from 2.2 to 1.8 and while the temperature was raised from 50° C. to 65° C.

The temperature of the mixture in the reaction vessel was further held at a value of 65° C. for 20 minutes.

477 ml of a 2.94 molar solution of a silver nitrate solution and 250 ml of a 2.94 molar solution of a sodium chloride were further added simultaneously at a linearly increasing addition rate for both starting from 8.8 ml up to 28 ml per minute while maintaining the pCl value at 1.8 at 65° C.

The temperature of the mixture in the reaction vessel was further held at a value of 65° C. for 30 minutes.

Into the mixture obtained in the reaction vessel 80 ml of a solution containing 2 g of potassium iodide were poured.

By double jet precipitation 70 ml of a solution of 2.94 molar of silver nitrate and 70 ml of a solution containing 2.94 molar of sodium chloride were added simultaneously at a rate of 8 ml per minute while maintaining the pCl value at 1.8 and the temperature at 65° C.

A transmission electron micrograph of the control emulsion A resulting from this preparation method is shown in FIG. 1.

Preparation of inventive Emulsion B (tabular silver chloroiodide emulsion, inventive emulsion, low degree of gelatin oxidation, low amount of calcium)

The same preparation method as for Emulsion A was performed in order to prepare a tabular silver chloroiodide emulsion except for the use of gelatin containing less than 40 ppm of calcium ions.

Figure 2:
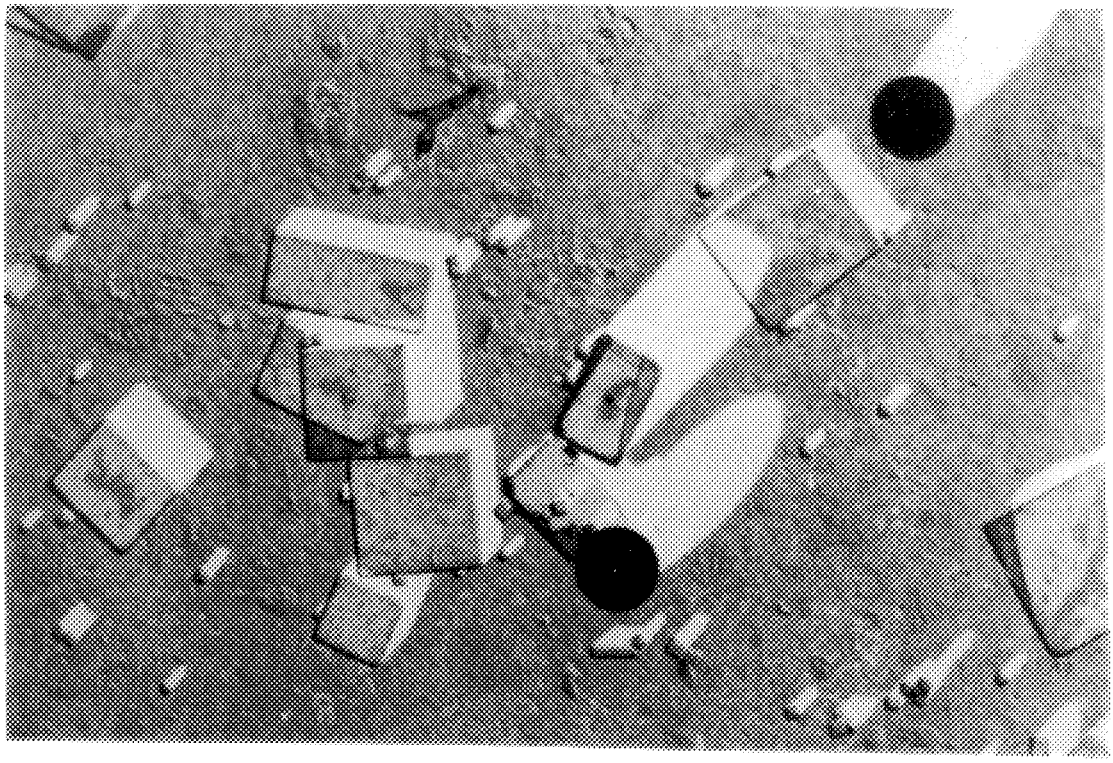

A transmission electron micrograph of the inventive emulsion B resulting from this preparation method is shown in FIG. 2.

Preparation of control Emulsion C (tabular silver chloroiodide emulsion, control emulsion, higher degree of gelatin oxidation if compared with control Emulsion A, high amount of calcium).

The same preparation method as for Emulsion A was performed in order to prepare a tabular silver chloroiodide emulsion except for the use of gelatin oxidized to a level of 1100 ppm of methionine.

Figure 3:
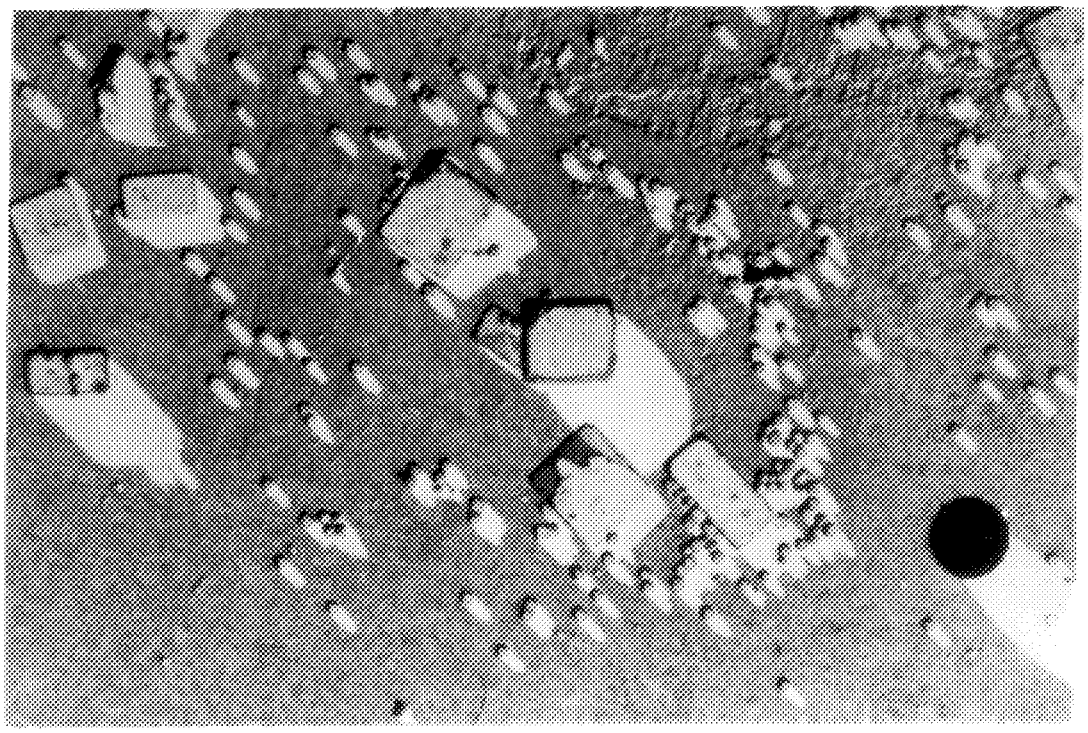

A transmission electron micrograph of the control emulsion C resulting from this preparation method is shown in FIG. 3.

Preparation of inventive Emulsion D (tabular silver chloroiodide emulsion, inventive emulsion, higher degree of gelatin oxidation if compared with control Emulsion A, low amount of calcium)

The same preparation method as for Emulsion A was performed in order to prepare a tabular silver chloroiodide emulsion except for the use of gelatin oxidized to a level of 1400 ppm of methionine and of the use of gelatin containing less than 40 ppm of calcium ions.

Figure 4:
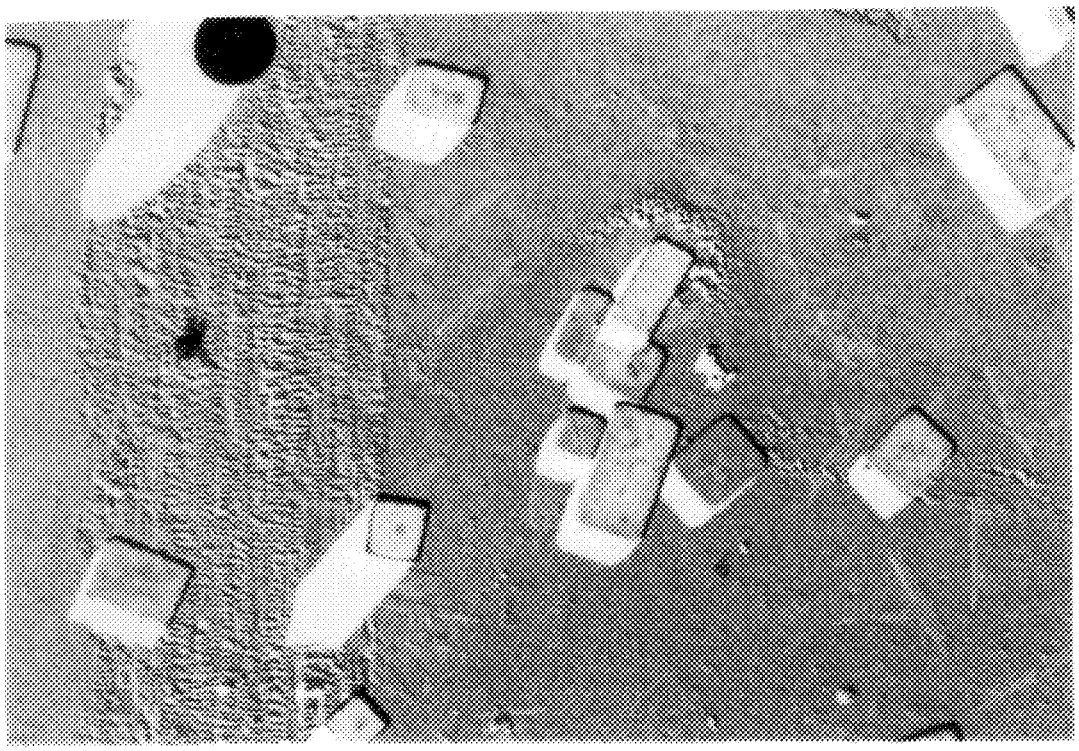

A transmission electron micrograph of the inventive emulsion D resulting from this preparation method is shown in FIG. 4.

Preparation of inventive Emulsion E (tabular silver chloroiodide emulsion, inventive emulsion, higher degree of gelatin oxidation if compared with control Emulsion D, low amount of calcium)

The same preparation method as for Emulsion A was performed in order to prepare a tabular silver iodochloride emulsion except for the use of gelatin oxidized to a level of 700 ppm of methionine and of the use of gelatin containing less than 40 ppm of calcium ions.

Figure 5:
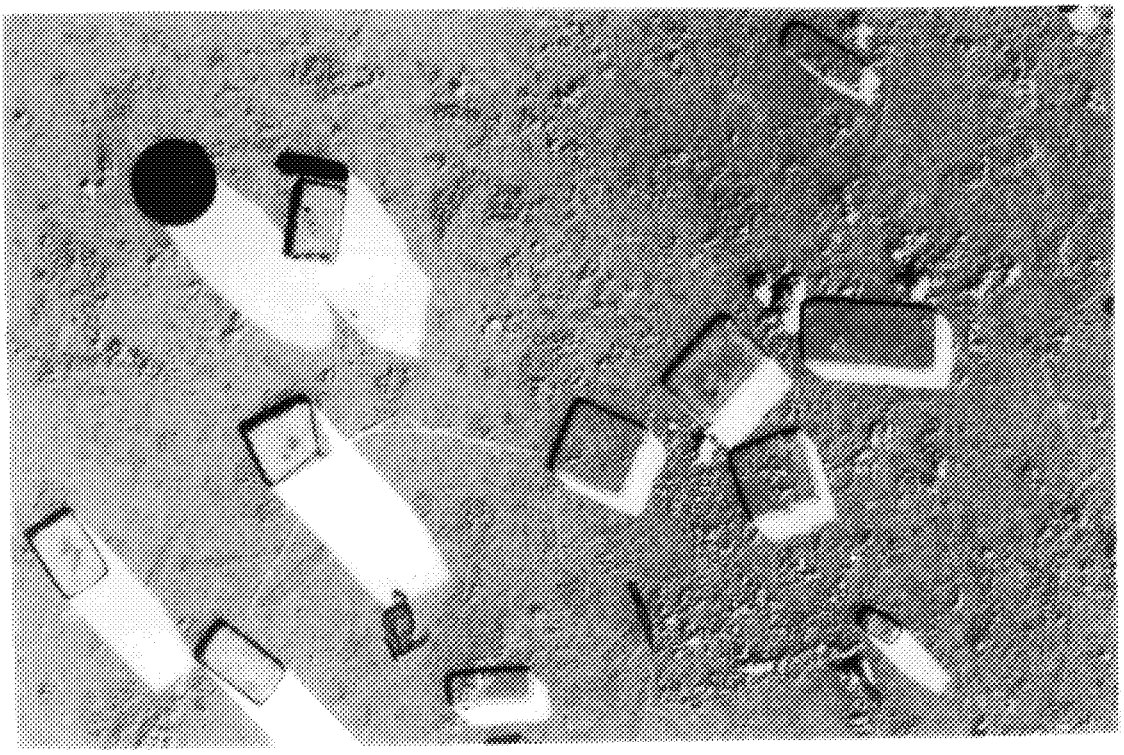

A transmission electron micrograph of the inventive emulsion E resulting from this preparation method is shown in FIG. 5.

Table 1 hereinafter gives a summary of the characteristics of the 5 emulsions with respect to degree of oxidation (lower amounts of methionin indicate that the gelatin is oxidised to a higher degree) and with respect to amount of calcium present in the gelatin used therein. The procentual number of tabular grains having a {100} crystal habit present in the 5 emulsions calculated from the FIGS. 1 to 5 is also represented.

TABLE 1

| Emulsion | ppm methionine | ppm calcium | % tabular grains |
|---|---|---|---|
| A (comp.) | 7000 | 5000 | <<0.5 |
| B (comp.) | 7000 | <40 | 5 |
| C (comp.) | 1100 | 5000 | 3 |
| D (inv.) | 1400 | <40 | 65 |
| E (inv.) | 700 | <40 | 45 |

From the FIGS. 1 to 5 and from the data derived therefrom as represented in Table 1, related with the procentual number of tabular grains obtained by the preparation methods described hereinbefore it can be concluded that a remarkable increase of the said tabular {100} grains rich in chloride is obtained as soon as the gelatin used in the preparation as a protective colloid has a low methionine content and a low calcium content.

In each of the photographs FIGS. 1 to 5, the black sphere that is present therein is a "reference sphere" having a diameter of exactly 1.00 μm, added to the emulsion in order to permit size measurement of the individual tabular {100}grains present in the emulsion.

We claim:

1. Method of preparing of a photographic silver halide emulsion comprising precipitating in one or more precipitation steps in a reaction vessel, followed by desalting by means of flocculation and washing or by means of ultrafiltration, said emulsion comprising gelatin as a binder and {100}tabular silver halide grains containing at least 50 mole % of chloride, wherein at least 40% by number of all grains is provided by said tabular grains, and wherein said tabular grains exhibit an average aspect ratio of at least 2, an average thickness of at most 0.5 μm, and an average equivalent circular crystal diameter of 0.3 μm or more, characterized in that during said precipitation step(s) said gelatin binder present in said reaction vessel is substantially free of calcium ions and is oxidised to a degree in order to have a methionine content of at most 4000 ppm.

2. Method according to claim 1, wherein said methionine content is at most 2500 ppm.

3. Method according to claim 1, wherein said tabular grain emulsion contain at least 90 mole % of chloride.

4. Method according to claim 1, wherein at least 60% by number of all grains is provided by said tabular grains.

5. Method according to claim 1, wherein the aspect ratio of said tabular grains is comprised between 3 and 50.

6. Method according to claim 1, wherein the average thickness of said tabular grains is from 0.04 μm to 0.30 μm.

7. Method according to claim 1, wherein the said {100} tabulair grains are silver chloroiodide grains.

8. Method according to claim 7, wherein iodide is provided by means of an iodide releasing agent.

9. Photographic material comprising a support and at least one light-sensitive silver halide emulsion layer on at least one side of said support, wherein said emulsion layer(s) comprise(s) one or more emulsion(s) containing {100} tabular silver halide emulsion grains prepared according to the method of claim 1.

10. Photographic material according to claim 9, wherein said photographic material is a single or double side coated X-ray material.

* * * * *

UNITED STATES PATENT AND TRADEMARK OFFICE

CERTIFICATE OF CORRECTION

PATENT NO. : 5,885,763

DATED : March 23, 1999

INVENTOR(S) : Peter Verrept et al

It is certified that error appears in the above-indentified patent and that said Letters Patent is hereby corrected as shown below:

On the face of Patent between Sections [22] and [51] the following should be inserted:

-- [30] Foreign Application Priority Data

-- Nov. 15, 1996 [EP] European Pat. Off. ... 96203207--; such data.

Column 8, line 7, "5'-dicyano-1, 1'-diethyl-3,3 '-di(2-acetoxyethyl)ethyl-" should read -- 5'-dicyano-1,1'-diethyl-3,3'-di(2-acetoxyethyl)ethyl- --.

Signed and Sealed this

Eighth Day of February, 2000

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,885,763

DATED : March 23, 1999

INVENTOR(S) : Peter Verrept et al

It is certified that error appears in the above-indentified patent and that said Letters Patent is hereby corrected as shown below:

On the title page, between Sections [22] and [51] the following should be inserted:

-- [30] Foreign Application Priority Data

Nov. 15, 1996 [EP] European Pat. Off....96203207--.

Column 8, line 7, "5'-dicyano-1, 1'-diethyl-3,3 '-di(2-acetoxyethyl)ethyl-" should read -- 5'-dicyano-1,1'-diethyl-3,3'-di(2-acetoxyethyl)ethyl- --.

This certificate supersedes Certiticate of Correction issued February 8, 2000.

Signed and Sealed this

Eighteenth Day of April, 2000

*Attest:*

Q. TODD DICKINSON

*Attesting Officer*

*Director of Patents and Trademarks*